US005200295A

United States Patent [19]

Vermeulen et al.

[11] Patent Number: 5,200,295

[45] Date of Patent: Apr. 6, 1993

[54] METHOD FOR THE PRODUCTION OF A SILVER IMAGE

[75] Inventors: Leon L. Vermeulen, Herenthout; Robert S. Pauwels, Brasschaat; Jean-Marie O. Dewanckele, Drongen, all of Belgium

[73] Assignee: AGFA-Gevaert N.V., Mortsel, Belgium

[21] Appl. No.: 804,610

[22] Filed: Dec. 10, 1991

[30] Foreign Application Priority Data

Dec. 18, 1990 [EP] European Pat. Off. ..... 90203374.5

[51] Int. Cl.[5] ..... G03C 5/54; G03C 1/48

[52] U.S. Cl. ..... 430/206; 430/227; 430/231; 430/232; 430/234; 430/244; 430/249; 430/251; 430/404; 430/448; 430/955

[58] Field of Search ..... 430/206, 231, 232, 234, 430/244, 249, 251, 404, 955, 492, 448

[56] References Cited

U.S. PATENT DOCUMENTS

| | | | |
|---|---|---|---|
| 3,179,517 | 4/1965 | Tregillus et al. | 430/206 |
| 3,260,598 | 7/1966 | Yutzy et al. | 430/206 |
| 3,390,859 | 1/1976 | Corrigan et al. | 430/404 |
| 3,450,535 | 6/1969 | Limberger et al. | 430/206 |
| 4,168,166 | 9/1979 | Land | 430/249 |
| 4,797,343 | 1/1989 | Nakamura | 430/955 |
| 5,009,984 | 4/1991 | DeRycke et al. | 430/206 |

*Primary Examiner*—Richard L. Schilling

*Attorney, Agent, or Firm*—Breiner & Breiner

[57] ABSTRACT

A method for the production of a silver image by the silver complex diffusion transfer reversal process, said method comprising the following steps:

(I) image-wise photo-exposing a silver halide emulsion layer of a photographic silver halide emulsion having in waterpermeable relationship with the silver halide at least one developing agent, (II) wetting with a practically neutral aqueous liquid the said photo-exposed silver halide emulsion layer and/or wetting with said liquid a development nuclei containing layer of an image-receiving material as defined hereinafter and contacting said materials thereby bringing said layers into waterpermeable relationship with each other, and (III) separating the contacted materials after formation in the image-receiving material of a silver image, wherein said image-receiving material contains in cooperable relationship: (i) physical development nuclei, (ii) a silver halide solvent being a silver complexing agent or precursor thereof, (iii) a watersoluble sulfite or sulfite precursor, and (iv) a mixture of sodium and/or potassium tetraborate and a sodium and/or potassium salt of an organic mono- or polycarboxylic acid, wherein the acid is characterized by at least one dissociation step corresponding at 25° C. with a dissociation constant smaller than $10^{-2.5}$, in other words a pKa value higher than 2.5.

20 Claims, No Drawings

METHOD FOR THE PRODUCTION OF A SILVER IMAGE

1. FIELD OF THE INVENTION

The present invention relates to a silver complex diffusion transfer reversal (DTR-) process wherein alkali is provided by the image-receiving material and the processing may proceed by the use of plain water.

2. BACKGROUND OF THE INVENTION

Silver halide emulsion materials are particularly useful in the production of black-and-white and colour images with high optical density and high resolving power but require in conventional processing aqueous alkaline processing liquids that may not come into contact with the skin because they have an irritating and skin destroying effect. Moreover, alkaline aqueous solutions pose ageing problems in that they become gradually neutralized by carbon dioxide absorbed from the air.

Under the impulse of said specific drawbacks and of ecological requirements there has been looked for a process wherein the alkaline substance is formed in situ during the processing of the photographic materials by means of originally non-corrosive alkali-generating chemicals and an aqueous liquid the pH of which is not much above 7 or wherein simply neutral plain water is used.

In the well known diffusion transfer reversal (DTR-) processing [ref. e.g. Photography—Its Materials and Processes—by C. B. Neblette—16th ed. D. Van Nostrand Company—New York (1962), p. 372] an exposed silver halide emulsion material is developed in alkaline medium in the presence of a silver ion complexing agent, also called silver halide solvent. Hereby the non-developed silver halide is complexed and transferred by diffusion into an image-receiving material to form therein a silver image by reduction with the aid of a developing agent in the presence of minute amounts of so-called development nuclei, e.g. colloidal silver or heavy metal sulphides. More details about the DTR process and substances used therein are given by André Rott and Edith Weyde in their book: "Photographic Silver Halide Diffusion Processes"—Focal Press—London, New York (1972).

Common in DTR-processing is the use of photosensitive silver halide emulsion materials that contain the necessary developing agent(s) applied already at their coating stage. The processing of such materials proceeds with a so-called activator solution which is a purily alkaline aqueous solution having originally a pH between 12 and 13 (see the above book of André Rott and Edith Weyde, p. 81).

In U.S. Pat. No. 3,260,598 a process for forming a silver negative image and for forming simultaneously a silver positive image in a processing element is described wherein for alkali-release in situ a very slightly watersoluble metal hydroxide $Z(OH)_n$ is allowed to react with a compound XY, wherein in the hydroxide Z represents a metal atom selected from the class consisting of cadmium, aluminium, zinc, titanium and lead, and in the XY-compound X represents sodium or potassium and Y represents a citrate radical, ferrocyanide radical, fluoride ion, tartrate radical, an ethylenedinitrilo tetraacetate (EDTA) radical, a 1,3-diamino-2-propanol tetraacetate radical, a trimethylaminetricarboxylate radical, a di-ω, ω-methylaminodiethylaminedicarboxylate radical or a di-ω, ω-methylaminodiethylaminetetracarboxylate radical.

For ecological reasons most of the above mentioned metal atoms represented by Z may not be introduced in the draining waste water or only in very limited concentrations. Moreover, as mentioned in published EP-A 0210659 the alkali-generation with said system has been found to be not very efficient.

In said published EP-A 0210659 a process for generating alkali is described, wherein a complexing agent such as sodium picolinate is allowed to react with e.g. zinc hydroxide or basic zinc carbonate to set free hydroxyl ions whereby the pH is raised.

Picolinic acid and the picolinates are rather expensive compounds so that preference is given to more economic base generating agents that are ecologically acceptable which is not the case e.g. for phosphates and non-biodegradable ethylenediaminetetraacetic acid (EDTA).

3. SUMMARY OF THE INVENTION

It is an object of the present invention to provide a silver complex diffusion transfer reversal (DTR-) process using plain water wherein alkali is provided by an ecologically acceptable not very expensive combination of alkalinity providing substances that are incorporated in the image-receiving material.

It is another object of the present invention to provide novel image-receiving materials suited for use in said DTR-process.

Further objects and advantages of the present invention will appear from the following description.

According to the present invention a method for the production of a silver image by the silver complex diffusion transfer reversal process comprises the following steps:

(I) image-wise photo-exposing a silver halide emulsion layer of a photographic silver halide emulsion material having in waterpermeable relationship with the silver halide at least one developing agent, (II) wetting with a practically neutral aqueous liquid the said photo-exposed silver halide emulsion layer and/or wetting with said liquid a development nuclei containing layer of an image-receiving material as defined hereinafter and contacting said materials thereby bringing said layers into waterpermeable relationship with each other, and (III) separating the contacted materials after formation in the image-receiving material of a silver image, wherein said image-receiving material contains in cooperable relationship: (i) physical development nuclei, (ii) a silver halide solvent being a silver complexing agent or precursor thereof, (iii) a watersoluble sulfite or sulfite precursor, and (iv) a mixture of sodium and/or potassium tetraborate and a sodium and/or potassium salt of an organic mono- or polycarboxylic acid, wherein the acid is characterized by at least one dissociation step corresponding at 25° C. with a dissociation constant smaller than $10^{-2.5}$, in other words a pKa value higher than 2.5.

By "a practically neutral aqueous liquid" is understood here plain water or an aqueous liquid the pH of which differs by no more than 0.5 from the value 7.

4. DETAILED DESCRIPTION OF THE INVENTION

A particularly useful alkalinity is obtained by the combination of said tetraborate, preferably borax, with sodium and/or potassium salts of organic carboxylic acids that in free state have a pKa value in the range from about 3 to 6.5. Preferably sodium and/or potassium salts of organic polycarboxylic acids are used of which the pKa value at 25° C. of the first dissociation step (pKa1) is about 3 and of the second dissociation step (pKa2) is larger than pKa1 but not larger than 5. Examples of such acids are tartaric acid (pKa1=2.98 and pKa2=4.34) and citric acid (pKa1=3.08 and pKa2=4.74).

In a preferred embodiment the sodium and/or potassium salt of tartaric acid is used. Gluconic acid of which the pKa value is about 3.5 (dissociation constant: $3.16\times10^{-4}$) is likewise advantageously applied in its sodium or potassium salt form and is ecologically completely acceptable. The pKa value is the negative logarithm of the dissociation constant value of the acid.

A survey of dissociation constants of organic acids in aqueous solutions is given in "Handbook of Chemistry and Physics"—Editor in Chief Charles D. Hodgman, M. S., 42nd ed.,—Published by the Chemical Rubber Publishing Co.—2310 Superior Ave., Ave. N.E. Cleveland, Ohio—U.S.A., p. 1756–1756.

In order to avoid that in the DTR-process a substantial amount of photo-exposed silver halide before its development is dissolved to a large extent by silver halide solvent and transferred in complexed state into the image-receiving material to stain therein the image background at least one of the following embodiments (A) to (C) may be applied.

According to an embodiment (A) the rate of silver halide development is speeded up by the presence of a development accelerator. A survey of development accelerators is given in Research Disclosure December 1989, item 308119 under the heading XXI. Development modifiers. Particularly suitable development accelerating compounds for application in the present invention are onium and polyonium compounds preferably of the ammonium, phosphonium and sulfonium type, especially quaternary sulfonium polyoxyalkylene salts as described in U.S. Pat. No. 4,028,110. The preparation of a particularly useful development accelerating compound is described furtheron in Example 1.

Preferably at least a part of the applied development accelerator is present in the photographic material, e.g. is applied already at the manufacturing stage in a hydrophilic colloid layer such as a anti-halation layer whereon the silver halide emulsion layer is coated or is present in the silver halide emulsion layer itself. A useful coverage of development accelerator incorporated preferably in the silver halide emulsion layer is in the range of 0.02 g/m$^2$ to 1 g/m$^2$.

According to an embodiment (B) which may be combined with embodiment (A) the diffusion of the diffusion of silver complexing agent, e.g. thiosulfate ions, into the developing photographic material from the contacting image-receiving material is retarded by a barrier layer of which the swelling power and the transfer therethrough of silver complexing agent is controlled by metal ions, e.g. potassium or calcium ions. In said embodiment the silver complexing agent, preferably thiosulfate, is applied in a waterpermeable hydrophilic colloid layer underneath said barrier layer and the physical development nuclei of the image-receiving material are applied in and/or on top of said barrier layer. Polymers that may applied for forming a barrier layer capable of delaying the diffusion therethrough of thiosulfate ions are described e.g. in U.S. Pat. No. 4,569,898. A particularly suitable polymer for said purpose is sodium cellulose sulfate the swell ratio of which is controlled by potassium ions. These potassium ions are applied e.g. in the coating composition of the layer containing a thiosulfate as silver complexing agent. Other suitable polymers for forming said barrier layer are propylene glycol alginate and the manucol ester of alginic acid the swell ratio of which is controlled by calcium ions.

According to an embodiment (C) which may be combined with embodiment (A) and/or (B) the silver halide complexing agent is set free timely from a precursor for silver ion complexation. An example of a precursor wherefrom thiosulfate ions can be set free by the action of hydroxyl ions (alkali) is described in U.S. Pat. No. 3,698,898.

At least part of the developing agents used in the DTR-processing is present in the photographic silver halide emulsion material. Preferred developing agents are hydroquinone type developing agents optionally in conjunction with auxiliary developing agents e.g. of the 3-pyrazolidinone type. The silver halide developing agent(s) are present preferably in a waterpermeable layer contiguous to the silver halide emulsion layer(s), e.g. in an outermost top layer. The coverage of the developing agent(s) is preferably in the range from 0.2 to 3 g/m$^2$.

Other ingredients that may be present in said outermost layer are e.g. substances reducing stickiness. Particularly useful for that purpose are solid polymer particles applied in a hydrophilic colloid binder from a polymethyl methacrylate latex.

According to a particular embodiment a compound generating a base thermally is used in the photographic material. After image-wise exposure said material is heated for releasing a free base so that less alkalinity has to be transferred from the image-receiving element. Suitable thermally base-releasing agents for that purpose are described e.g. in GB-P 998,949 in DE-OS 3,529,934 and in U.S. Pat. No. 4,912,028.

The process of the present invention can be applied with any type of silver halide emulsion material of the negative working type or direct positive working type. The silver halide in said materials may be e.g. silver chloride, silver bromide, silver chlorobromide, silver bromide-iodide or mixtures thereof. A survey of silver halide emulsion preparation, their chemical and spectral sensitisation, stabilisation against fog, additives, binders and coating systems is given e.g. in Research Disclosure December 1978, item 17643 and in Research Disclosure November 1989, item 307105, wherein likewise a survey of suitable supports for silver halide emulsion layers is mentioned. More detailed non-limitative information about the composition of particularly useful silver halide emulsion ingredients is given furtheron.

The image-receiving material may contain any type of physical development nuclei known in the art preferably incorporated in a hydrophilic colloid binder to form an image-receiving layer carried by a support. Examples of suitable hydrophilic colloid binding agents for the physical development nuclei are those referred to hereinafter as binder for the silver halide in the photographic silver halide emulsion layer material.

A survey of physical development nuclei that are suited for use in the DTR image-receiving material for promoting the reduction to metallic silver of complexed silver salt is given in the above-mentioned book of A. Rott and E. Weyde, p. 54–57. Particularly suited are nickel sulphide nuclei, nickel-silver sulphide nuclei and palladium sulphide nuclei.

The DTR image-receiving material may contain any type of silver halide complexing agent acting as silver halide solvent. Preference is given however, to a water-soluble thiosulfate compound, e.g. sodium thiosulfate. Good results are obtained with sodium thiosulfate at a coverage in the range from 0.10 to 0.8 g per $m^2$.

According to a preferred embodiment the image-receiving material contains the sulfate in the form of an alkali metal sulfite, preferably sodium sulfite. Good results are obtained with a coverage of sulfite ions in the range from 0.025 to 0.25 g per $m^2$.

The presence of sulfite improves the image quality and yields a more clear image background.

The use of an alkali metal sulfite is particularly interesting when combined with a hydroquinone type developing agent, since an alkali metal sulfite reacts with the quinone formed in the silver halide development and produces thereby an alkali metal hydroxide acting as a strong base accelerating the development [ref. the book "Modern Photographic Processing"—Vol. 1, by Grant Haist—A Wiley-Interscience Publication—John Wiley and Sons New York—p. 490].

The molar ratio of the sodium and/or potassium tetraborate with respect to the (poly)carboxylic acid sodium and/or potassium salt, preferably the sodium and/or potassium salt of tartaric acid, present in the image-receiving material is preferably from ½ to 3/1. The coverage of sodium and/or potassium tetraborate is preferably in the range from 1.1 to 4.0 gram per $m^2$.

According to a particular embodiment the alkali-providing substances and the sulfite are contained in a waterpermeable hydrophilic colloid outermost layer coated onto the image-receiving layer, whereas the silver complexing agent or precursor thereof is contained in the image-receiving layer containing the development nuclei.

In order to improve its mechanical strength the image-receiving layer or a hydrophilic colloid top-coat thereon may be hardened with a hardening agent as referred to hereinafter in connection with a gelatin silver halide emulsion layer.

Further information on the composition of the image-receiving layer can be found in said book of André Rott and Edith Weyde p. 50–65 and in Research Disclosure November 1976, item 15162.

The silver halide particles of the photographic emulsions used according to the present invention may have a regular crystalline form such as a cubic or octahedral form or they may have a transition form. They may also have an irregular crystalline form such as a spherical form or a tabular form, or may otherwise have a composite crystal form comprising a mixture of said regular and irregular crystalline forms.

In a silver halide emulsion layer the silver halide is present in a hydrophilic waterpermeable colloid binder, preferably gelatin.

The gelatin can be lime-treated or acid-treated gelatin. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966).

Gelatin can be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents or by grafting of polymerizable monomers on gelatin, and cellulose derivatives such as hydroxyalkyl cellulose, carboxymethyl cellulose, phthaloyl cellulose, and cellulose sulphates.

The binder of the silver halide, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts. Hardening may be effected also by incorporating a latent hardener in the colloid layer, whereby a hardener is released at the stage of applying the alkaline processing liquid.

The light-sensitive silver halide can be spectrally sensitized with methine dyes e.g. with those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, holopolar cyanine dyes, hemicyanine dyes, styryl dyes and hemioxonol dyes. Particularly valuable dyes are those belonging to the cyanine dyes, merocyanine dyes, complex merocyanine dyes.

The silver halide emulsions for use in accordance with the present invention may comprise compounds preventing the formation of fog or stabilizing the photographic characteristics during the production or storage of the recording element or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercapto-tetrazole, mercaptopyrimidines, mercaptotriazines, benzothiazoline-2-thione, oxazolinethione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JA-Appl. 75-39537, and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid, benzenethiosulphonic acid amide.

For improving the image sharpness the silver halide emulsion layer is applied onto an antihalation layer as described e.g. in U.S. Pat. No. 4,144,064 and published European patent application 0 197 202.

The DTR image-receiving material as well as the photographic material may be used in sheet, web or ribbon form and their layers may be coated with any technique known in the art, e.g. air knife coating, meniscus coating, slide hopper coating and curtain coating. The development nuclei may be applied by spraying on top of an outermost hydrophilic colloid layer containing the alkali providing substances.

Normally the photographic DTR material is in the form of a sheet and is processed in contact with an image-receiving DTR material in sheet form, e.g. by conveying them in contact between pressure rollers as are present in classical diffusion transfer reversal apparatus some types of which are described in "Photographic Silver Halide Diffusion Processes" by André Rott and Edith Weyde, Focal Press—London—New York (1972) p. 242-256.

Photographic materials in sheet form may be advantageously processed likewise by contacting with an image-receiving web delivered by a spool.

When the photographic material and image-receiving material are in the form of a web or ribbon the photographic material and image-receiving material are each supplied in said form from different spools. In connection herewith the attention is drawn to an apparatus suitable for web processing of pre-wetted photographic material and DTR-receptor material described in Neblette's Handbook of Photography and Reprography, 7th ed. Edited by John M. Sturge (1977) p. 253-254 under the trade name DITRICON of HRB-Singer. An arrangement for rapid film or web processing is illustrated in the already mentioned book of André Rott and Edith Weyde, p. 156.

To obtain a very rapid moistening the photographic material and/or the image-receiving material may be coated with or contain a wetting agent. Examples of particularly useful wetting agents are fluoroalkyl wetting agents, e.g. of the type described in Belgian Patent Specification 742,680 and the anionic wetting agents described in EP 0 014 008.

According to a preferred embodiment the practically neutral aqueous processing liquid is applied in a device wherein the photographic material is pre-wetted only at the layer side wherein development has to take place and the single side wetted photographic material is contacted with a dry image-receiving material. An apparatus suited for that purpose comprises a pair of cooperating driving rollers, means for driving said rollers, a platform for supporting the photographic material before its engagement by said rollers and pre-wetting and a second platform supporting plate for guiding the processing sheet between the nip of pressure rollers that press the pre-wetted photographic material and dry image-receiving material together, whereupon once the development and diffusion transfer of complexed silver halide has been completed the contacting materials are separated.

According to a particular embodiment the practically neutral aqueous liquid used in the development is applied by meniscus coating operating with a lick-roller taking directly or through the intermediary of one or more other rollers (offset rollers) a small but sufficient amount of liquid from a tray while the photographic material or image-receiving material passes on top or underneath of the lick-roller where a liquid meniscus is formed between the roller and said material. Using that technique it is possible to apply only very small amounts of liquid, e.g. in the range of 20 to 60 ml per m2 that are consumed almost completely. No or only a minor amount of aqueous liquid is returned into the liquid container so that development and DTR-processing takes place always with fresh liquid and no waste liquid is left or formed.

The following example illustrates the present invention without, however, limiting it thereto. All ratios, percentages and parts are by weight unless otherwise stated.

EXAMPLE

Preparation of Silver Complex Diffusion Transfer Recording Material

Antihalation Layer

An antihalation layer on the basis of gelatin and carbon black was applied to a polyethylene coated paper support which before coating was corona-treated to improve its adherence to gelatin. The coating of that layer proceeded in such a way that the reflection optical density for visual filter light measured with a MACBETH (registered trade mark) RD-100R densitometer after drying was 1.5. "Visual filter"-light is light having a spectral range distribution approximately characteristic for the human eye sensitivity. The weight ratio of gelatin to carbon black was 10/1.

Before coating the anti-halation layer composition a 1% aqueous solution of a sulfonium type development accelerator prepared as described hereinafter, were added thereto in an amount of 10 ml per liter.

Preparation of the Silver Halide Emulsion and its Coating

To a washed gelatin silver chlorobromide emulsion (98.2 mole % of chloride) a spectral sensitizing agent with structural formula 1 of Table 1 of published European patent application 0 197 202, common stabilizing agents, hydroquinone and 1-phenyl-4-methyl-3-pyrazolidinone as developing agents were added. Thereupon to said emulsion 10 ml per liter of said 1% solution of the already mentioned development accelerator was added.

The coating of the emulsion onto the antihalation layer proceeded in such a way that the silver halide was present at a coverage equivalent with 2.0 g of silver nitrate per sq.m. The weight ratio of gelatin with respect to the silver halide expressed as silver nitrate was 1.2.

Preparation of the Image-Receiving Material

Onto a polyethylene coated paper support which before coating was corona-treated to improve its adherence to gelatin a DTR-image receiving layer was applied from the following aqueous coating liquid:

| | |
|---|---|
| water | 678 ml |

-continued

| | |
|---|---|
| 0.20% aqueous dispersion of colloidal silver-nickel sulphide developing nuclei in 5.6% gelatin solution | 25 ml |
| gelatin | 20 g |
| 10% aqueous solution of wetting agent A | 10 ml |
| 12.5% aqueous solution of wetting agent B | 2 ml |
| 4.8% aqueous solution of dimethylol urea | 28 ml |
| 2% aqueous solution of alginic acid lower alkyl ester | 50 ml |
| SYNTHARESIN K 30 (trade name for a silica sol) | 100 ml |
| 20% aqueous solution of polyacrylamide | 50 ml |
| sodium thiosulphate | 25 g |

Said composition was applied at a gelatin coverage of 1.50 g/m$^2$ and dried.

Onto the dried DTR-image receiving layer the following aqueous coating liquid was applied to form a topcoat containing an alkali providing composition:

| | |
|---|---|
| water | 435 ml |
| gelatin | 25.0 g |
| 10% aqueous formaldehyde solution | 1.8 ml |
| 1% ethanolic 1-phenyl-5-mercaptotetrazole solution | 8 ml |
| 12.5% aqueous solution of wetting agent B | 10 ml |
| 5% aqueous solution of wetting agent C | 2 ml |
| sodium tetraborate.10 water | 38 g |
| sodium salt of tartaric acid | 19.4 g |
| sodium sulphite | 4.5 g |

Said composition was applied at a gelatin coverage of 1.00 g/m$^2$ and dried.

Wetting agent A corresponds to the following chemical formula: i-$C_8H_{17}$-phenylene-O($CH_2$—$CH_2O$)$_8$CH-$_2$COONa.

Wetting agent B corresponds to the following chemical formula: oleyl-CON($CH_3$)—$CH_2$—$CH_2SO_3Na$.

Wetting agent C corresponds to the following chemical formula: $C_7F_{15}COONH_4$.

Exposure and Processing

In a vertical darkroom camera without reversing mirror the photographic material was exposed to a continuous tone black-and-white wedge print. The positioning and exposure proceeded under red safelight conditions. The exposure proceeded with the emulsion layer side of the photographic material towards the camera lens. Hereby in DTR-processing a wrong-reading negative was obtained on the photosensitive material for obtaining a right reading positive print in the image-receiving layer.

After the exposure the photographic material was introduced under the same safelight conditions into a diffusion transfer processing apparatus containing plain water at room temperature (about 20° C.) whereby its silver halide emulsion layer side was wetted only and placed with its wetted side into contact with the image-receiving layer of the above defined image-receiving material and kept in contact therewith for 60 seconds before separation.

In the image-receiving material a wedge print was obtained of which the maximum image density was 3.33 and the non-image background density was 0.62 both densities being measured in transmission.

Preparation of the Development Accelerator

Reaction scheme:

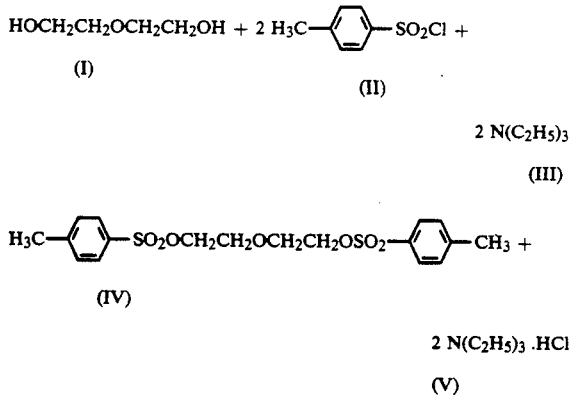

6.25 l of acetone, 2.65 kg (25 mole) of diethyleneglycol and 10.475 kg (55 mole) of p-tolusulfochloride were put into a 40 l jacketed glass-enameled steel reactor provided with impeller stirrer, thermometer and addition funnel. 5.833 g (57.5 mole) of triethylamine were added dropwise while stirring and maintaining inside the reactor a maximum temperature of 30° C. by circulating cooling water in the cavity wall of the reactor. The addition lasted 3 to 4 h. At the end of the addition a highly viscous slurry was obtained requiring strong stirring. Stirring was continued for 2 h at a temperature not surpassing 30° C.

The reaction mixture was kept overnight whereupon 10 l of methanol were added. The mixture was cooled down within the range of 0° to 5° C.

The white crystalline precipitate formed was separated by filtering and dissolved again for washing with 25 l of water. The crystalline material was separated again by filtering and rinsed on the filter with water till the filtrate became chloride-free. The crystalline product was then washed twice with 30 l of methanol and dried in a ventilated stove at about 50° C.

Yield: 8.6 kg of diester (IV) having a melting point of 88° C.

We claim:

1. A method for the production of a silver image by the silver complex diffusion transfer reversal process, said method comprising the following steps:

(I) image-wise photo-exposing a silver halide emulsion layer of a photographic silver halide emulsion material having in waterpermeable relationship with the silver halide at least one developing agent.

(II) wetting with a practically neutral aqueous liquid the said photo-exposed silver halide emulsion layer and/or wetting with said liquid a development nuclei containing layer of an image-receiving material as defined hereinafter and contacting said materials thereby bringing said layers into waterpermeable relationship with each other, and (III) separating the contacted materials after formation in the image-receiving material of a silver image, wherein said image-receiving material contains in cooperable relationship: (i) physical development nuclei, (ii) a silver halide solvent being a silver complexing agent or precursor thereof, (iii) a watersoluble sulfite or sulfite precursor, and (iv) a mixture of sodium and/or potassium tetraborate and a sodium and/or potassium salt of an organic mono- or polycarboxylic acid, wherein the acid is characterized by at least one dissociation step corresponding at 25° C. with a dissociation constant smaller than $10^{-2.5}$, in other words a pKa value higher than 2.5.

2. Method according to claim 1, wherein said organic mono- or polycarboxylic acid is a carboxylic acid that in free state has a pKa value in the range from about 3 to 6.5.

3. Method according to claim 2, wherein the pKa value at 25° C. of the first dissociation step (pKa1) is about 3 and of the second dissociation step (pKa2) is larger than pK1 but not larger than 5.

4. Method according to claim 1, wherein said organic acid is tartaric acid.

5. Method according to claim 1, wherein in order to avoid that in the DTR-process a substantial amount of photo-exposed silver halide is dissolved by silver halide solvent before development of the silver halide at least one of the following embodiments (A) (B) and (C) is applied:

(A) the rate of silver halide development is speeded up by the presence of a development accelerator, (B) the diffusion of silver complexing agent into the developing photographic material from the contacting image-receiving material is retarded by a barrier layer of which the swelling power and the transfer therethrough of silver complexing agent is controlled by metal ions, and (C) the silver halide complexing agent is set free timely from a precursor for silver ion complexation.

6. Method according to claim 5, wherein the development accelerator is an onium or polyonium compound of the ammonium, phosphonium or sulfonium type.

7. Method according to claim 6, wherein at least a part of said development accelerator is present in the photographic material in a coverage in the range of 0.02 $g/m^2$ to 1 $g/m^2$.

8. Method according to claim 1, wherein a watersoluble thiosulfate compound is used as silver halide solvent.

9. Method according to claim 8, wherein sodium thiosulfate is used in the image-receiving material in a coverage in the range from 0.10 to 0.8 g per $m^2$.

10. Method according to claim 1, wherein the image-receiving material contains alkali metal sulfite corresponding with a sulfite ion coverage in the range from 0.025 to 0.25 g per $m^2$.

11. Method according to claim 1, wherein in the image-receiving material the sodium and/or potassium tetraborate is present with respect to the (poly)carboxylic acid sodium and/or potassium salt in a molar ratio from ½ to 3/1.

12. Method according to claim 11, wherein the coverage of sodium and/or potassium tetraborate is in the range from 1.1 to 4.0 gram per $m^2$.

13. An image-receiving material containing in cooperable relationship:

(i) physical development nuclei, (ii) a silver halide solvent being a silver complexing agent or precursor thereof, (iii) a watersoluble sulfite or sulfite precursor, and (iv) a mixture of sodium and/or potassium tetraborate and a sodium and/or potassium salt of an organic mono- or polycarboxylic acid, wherein said acid is characterized by at least one dissociation step corresponding at 25° C. with a dissociation constant smaller than $10^{-3}$, in other words pKa value higher than 3.

14. Material according to claim 13, wherein said organic mono- or polycarboxylic acid is a carboxylic acid that in free state has a pKa value in the range from about 3 to 6.5.

15. Material according to claim 14, wherein the pKa value at 25° C. of the first dissociation step (pKa1) is about 3 and of the second dissociation step (pKa2) is larger than pK1 but not larger than 5.

16. Material according to claim 13, wherein said organic acid is tartaric acid.

17. Material according to claim 13, wherein a watersoluble thiosulfate compound is present as silver halide solvent.

18. Material according to claim 13, wherein sodium thiosulfate is present in a coverage in the range from 0.10 to 0.8 per $m^2$.

19. Material according to claim 13, wherein the image-receiving material contains alkali metal sulfite corresponding with a sulfite ion coverage in the range from 0.025 to 0.25 g per $m^2$.

20. Material according to claim 13, wherein the sodium and/or potassium tetraborate is present with respect to the (poly)carboxylic acid sodium and/or potassium salt in a molar ratio from ½ to 3/1.

* * * * *